US007759618B2

(12) United States Patent
Beatson

(10) Patent No.: US 7,759,618 B2
(45) Date of Patent: Jul. 20, 2010

(54) SILICON CARBIDE HEATING ELEMENTS

(75) Inventor: John George Beatson, Perth (GB)

(73) Assignee: Sandvik Materials Technology UK Limited, Perth (GB)

( * ) Notice: Subject to any disclaimer, the term of this patent is extended or adjusted under 35 U.S.C. 154(b) by 207 days.

(21) Appl. No.: 10/564,111

(22) PCT Filed: Jul. 16, 2004

(86) PCT No.: PCT/GB2004/003106

§ 371 (c)(1),
(2), (4) Date: Jan. 10, 2006

(87) PCT Pub. No.: WO2005/009081

PCT Pub. Date: Jan. 27, 2005

(65) Prior Publication Data

US 2006/0198420 A1 Sep. 7, 2006

(30) Foreign Application Priority Data

Jul. 16, 2003 (GB) ..... 0316658.4

(51) Int. Cl.
*H05B 3/10* (2006.01)
*H05B 3/62* (2006.01)

(52) U.S. Cl. ..... 219/553; 219/552; 338/322; 338/296; 338/316; 373/117; 373/131; 216/16; 216/101; 216/52; 216/53; 29/610.1

(58) Field of Classification Search ..... 219/552–3; 373/117, 131; 216/16, 101, 52–3; 29/610.1; 338/322, 296, 316
See application file for complete search history.

(56) References Cited

U.S. PATENT DOCUMENTS

| | | | | |
|---|---|---|---|---|
| 650,234 | A | 5/1900 | Fitzgerald | |
| 2,431,326 | A | 11/1947 | Heyroth | |
| 2,546,142 | A | 3/1951 | Watson | |
| 3,094,679 | A | 6/1963 | O'Connor et al. | |
| 3,859,501 | A | 1/1975 | Matys | |
| 3,875,477 | A | 4/1975 | Fredriksson et al. | |
| 3,964,943 | A * | 6/1976 | Andersen | 216/16 |
| 4,272,639 | A | 6/1981 | Beck | |
| 4,555,358 | A | 11/1985 | Matsushita et al. | |
| 5,965,051 | A | 10/1999 | Hirayama et al. | |
| 6,090,733 | A | 7/2000 | Otsuki et al. | |
| 6,214,755 | B1 | 4/2001 | Otsuki et al. | |
| 6,250,127 | B1 * | 6/2001 | Polese et al. | 72/256 |
| 2006/0061020 | A1 | 3/2006 | Wynn | |

FOREIGN PATENT DOCUMENTS

| | | | |
|---|---|---|---|
| CN | 1264787 | A | 8/2000 |

(Continued)

OTHER PUBLICATIONS

First Office Action dated Oct. 10, 2008 for Chinese Patent Application No. 200480020464.3 and English Translation of the same.

(Continued)

*Primary Examiner*—Shawntina Fuqua
(74) *Attorney, Agent, or Firm*—Buchanan Ingersoll & Rooney PC

(57) ABSTRACT

A strip-form silicon carbide furnace heating element is provided having a higher radiating surface area to volume ratio than a conventional tubular element.

18 Claims, 4 Drawing Sheets

FOREIGN PATENT DOCUMENTS

| | | | |
|---|---|---|---|
| DE | 11 24 166 | B | 2/1962 |
| DE | 0301457 | | 10/1983 |
| DE | 301457 | A7 | 10/1983 |
| DE | 1124166 | B | 7/2005 |
| EP | 1109423 | A1 | 6/2001 |
| GB | 513728 | | 10/1939 |
| GB | 989502 | | 4/1965 |
| GB | 1222887 | | 2/1971 |
| GB | 1222887 | A | 2/1971 |
| GB | 1279478 | | 6/1972 |
| GB | 1423136 | | 1/1976 |
| GB | 1459252 | | 12/1976 |
| GB | 1 497 871 | A | 1/1978 |
| GB | 1497871 | | 1/1978 |
| JP | 54-87950 | A | 7/1979 |
| JP | 540087950 | A | 7/1979 |
| JP | 1100888 | A | 4/1989 |
| JP | 4-81934 | | 7/1992 |
| JP | 4230985 | A | 8/1992 |
| JP | 5315056 | A | 11/1993 |
| JP | 08-219648 | | 8/1996 |
| JP | 9-213462 | A | 8/1997 |
| JP | 090213462 | A | 8/1997 |
| JP | 9255428 | A | 9/1997 |
| JP | 10302940 | A | 11/1998 |
| JP | 2000048936 | A | 2/2000 |
| JP | 2001-77183 | | 3/2001 |
| JP | 2001-181047 | | 7/2001 |
| JP | 2001-257056 | | 9/2001 |
| JP | 2002-203662 | | 7/2002 |
| JP | 2002338366 | A | 11/2002 |
| JP | 2003073168 | A | 3/2003 |
| JP | 2003277929 | A | 10/2003 |
| JP | 2003327478 | A | 11/2003 |
| JP | 2005149973 | A | 6/2005 |
| SU | 1043007 | A | 9/1983 |
| WO | WO 95/12093 | | 5/1995 |
| WO | WO 03/075613 | | 9/2003 |

OTHER PUBLICATIONS

Chinese Patent Application No. CN1264687, Publication Date: Aug. 30, 2000 and English Translation of the same.

Preliminary Notice of Reasons for Rejection mailed Jun. 23, 2009 for Japanese Patent Application No. 2006-520015 and English Translation of the same.

Search Report under Section 37 dated Feb. 2, 2004 for Great Britain Application No. GB0316658.4.

Combination Search and Examination Report Under Sections 17 & 18(3) dated Feb. 3, 2004 for Great Britain Application No. GB0316658.4.

Examination Report under Section 18(3) dated May 19, 2005 for for Great Britain Application No. GB0316658.4.

Erema Heating Element Model, Copyright 2007 Tokai Konetsu Kogyo Co., Ltd.

"Three Piece Straight Alpha Rods," Silcarb Heating Elements Private Limited, Business Online, Bangalore, 2005.

"U-Shaped Alpha Rods," Silcarb Heating Elements Private Limited, Business Online, Bangalore, 2005.

"Heating Elements," Silcarb Heating Elements Private Limited, Business Online, Bangalore, 2005.

"SiC Heating Elements (heater)," Songshan Enterprise Group, www.songshangroup.com.

"U, W, and Y—Multiple Leg Starbars, Silicon Carbide Heating Elements," Starbar, Silicon Carbide Heating Elements, I Squared R Element Co., Inc., ST-SER.DOC Rev. 3, pp. 1-8.

"Silicon Carbide Heating Elements Molybdenum Disilicide Heating Elements," Starbar, Moly-D, I Squared R Element Co., Inc., www.isquaredrelement.com.

SiC Heater, Advanced Material Technical Report, Sumitomo Osaka Cement Co., Ltd. 2003.01, pp. 1-8.

iC heaters, Morgan Advanced Ceramics (MAC), Booth No. A4 414.

Ultra Pure SiC Heating Elements, MAC Hudson, Morgan Advanced Ceramics, pp. 1-2.

* cited by examiner

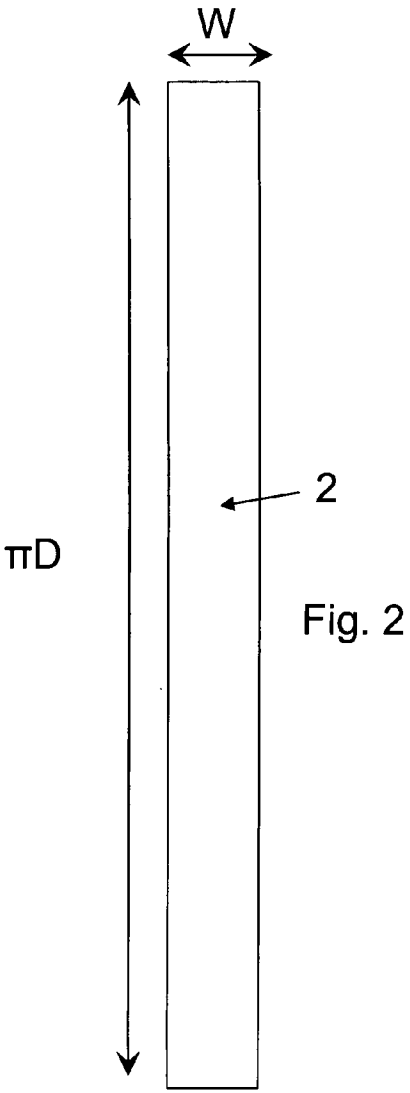
Fig. 2
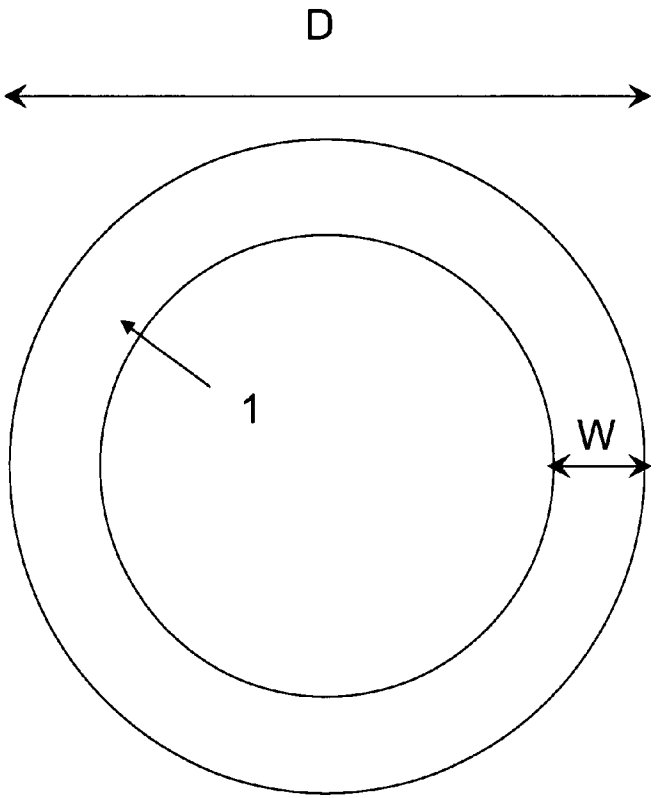
Fig. 1 – Prior Art

SILICON CARBIDE HEATING ELEMENTS

CROSS REFERENCE TO RELATED APPLICATIONS

This application is the U.S. national phase of International Application No. PCT/GB2004/003106 filed Jul. 16, 2004 published in English Jan. 27, 2005 as International Publication No. WO 2004/009081 A1, which application claims priority to Great Britain Application No. 0316658.4 filed Jul. 16, 2003, the contents of which are incorporated by reference herein.

Silicon carbide heating elements conventionally are manufactured in the form of solid rods or cylindrical tubes, typically in diameters between 3 mm and 110 mm diameter. Other cross sections are also possible, such as square or rectangular tubes, but are not in common use.

Elements of a tubular cross-section are more economical to produce, using less silicon carbide than solid elements, and most silicon carbide elements used in industrial furnaces feature a tubular construction.

Silicon carbide furnace heating elements should be distinguished from electrical igniters, which are designed to produce a rapid increase and decrease in heat so as to ignite a combustible material. Igniters need to be small to provide such rapid heating and cooling. Furnace heating elements are required to provide electrical heat at elevated temperatures and for prolonged periods (e.g. several years at temperature). The design criteria for furnace heating elements and electrical igniters are thus extremely different.

The power availability of any radiant heating elements is a function of its radiating surface area, and the capability of any given element type is usually expressed in watts per square cm of that radiating surface.

In the case of tubular silicon carbide elements, only the external surface area is considered as useful radiating surface as there is no radiative heat transfer from the inner surfaces of the tube to the surroundings.

Silicon carbide is a relatively expensive ceramic material, particularly in the grades used in the manufacture of high temperature electric heating elements, so the use of less material would have a significant cost benefit The applicant has realised that if the ratio between the useful radiating surface and the cross-sectional area of the heating elements is increased, additional power may be provided from an element of similar cross-sectional area to a conventional tubular or solid element, or alternatively a similar power from a smaller and lighter element, while using less mass of silicon carbide.

Accordingly the present invention provides a strip form silicon carbide furnace heating element.

Preferably the heating elements are non-hollow.

Preferably the heating elements have a cross-sectional aspect ratio of greater than 3:1, more preferably greater than 5:1, yet more preferably greater than 10:1.

By aspect ratio is meant the ratio of the width to thickness of the strip.

Further features of the invention are made clear in the claims in the light of the following illustrative description, and with reference to the drawings in which:—

FIG. 1 shows a cross section of a conventional tubular heating element

FIG. 2 shows the tubular element unrolled to form a strip element in accordance with the present invention;

Figure 3:
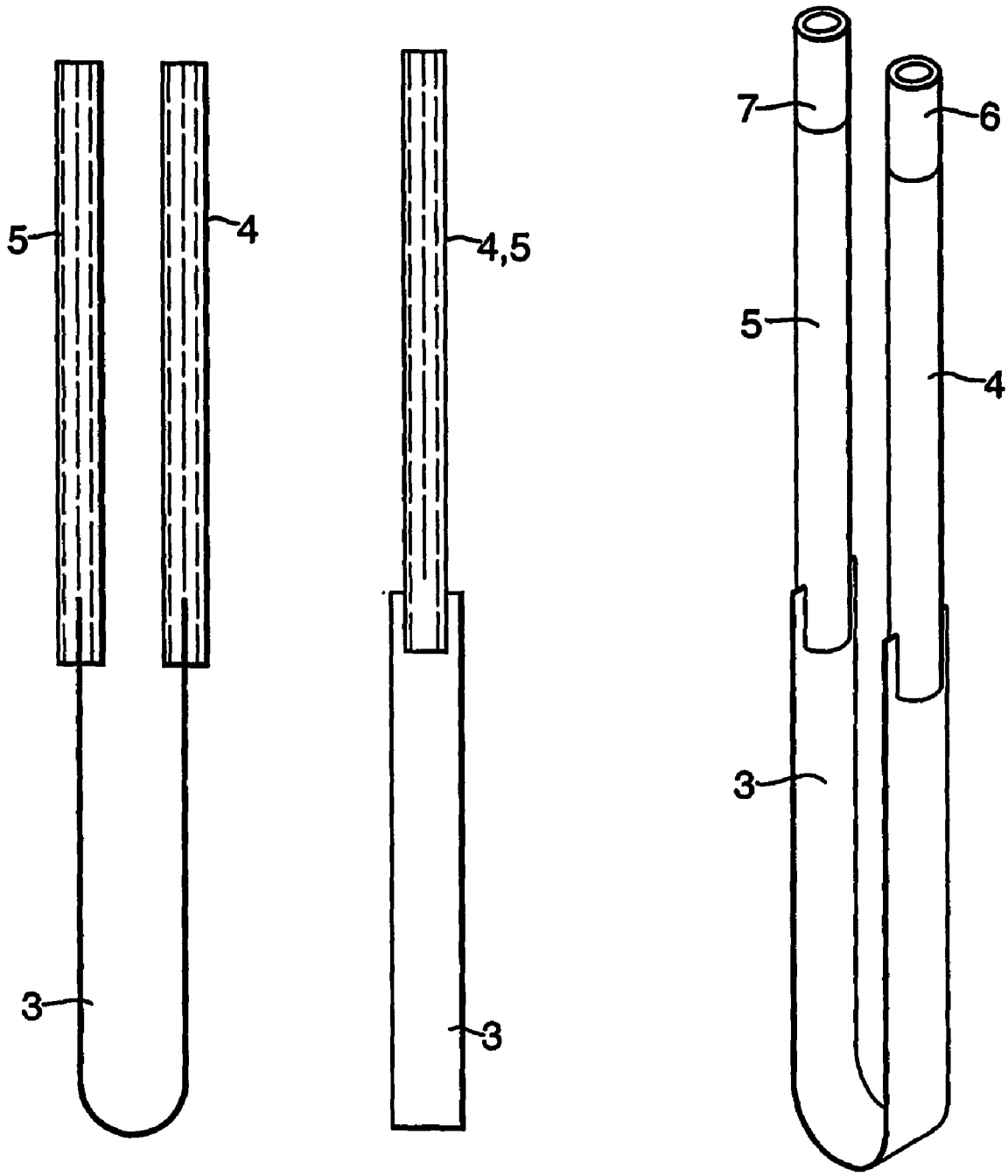
FIG. 3 shows a U-shaped 3 part heating element in accordance with the present invention.

In FIG. 1 a conventional tubular heating element 1 has a diameter D and wall thickness W. The surface area that can radiate is defined by the perimeter $\pi D$ of the element. The cross sectional area of the material of the tube approximates to $\pi DW$.

In FIG. 2, the tube is shown unrolled to form a strip 2 of length $\pi D$ and thickness W. Again, the cross sectional area of the material of the tube approximates to $\pi DW$, but the surface area that can radiate is given by the perimeter $2\pi(D+W)$ of the element. Unrolling the tube effectively doubles the radiating surface while leaving the material cross sectional area unchanged.

Additionally, the overall area of the tube 1 is $\pi D^2/4$ whereas that of the strip 2 is $\pi DW$. So the ratio of area of strip to tube is 4 W/D. For a tube of diameter 40 mm and wall thickness 5 mm this results in a ratio of the overall area of the strip to tube of 0.5. By reducing the overall area of the element, a smaller hole in a furnace wall can be considered.

This heating section may be flat, but for many uses, it is anticipated that the heating section will be bent one or more times, particularly out of the plane of the strip, to suit installation in various types of equipment, but especially in indirect electric resistance furnaces.

FIGS. 3. and 4 show one possible shape (a U) for the heating section. In FIG. 3 a 3-part heating element comprises a simple U-shaped strip 3 providing a high resistivity hot zone, connected to low resistance 'cold ends' 4,5 of conventional form, where the resistivity of the cold end is lower than that of the heating section and/or has a larger cross-sectional area. Terminal ends 6,7 serve for electrical connection to a power supply.

Figure 4:
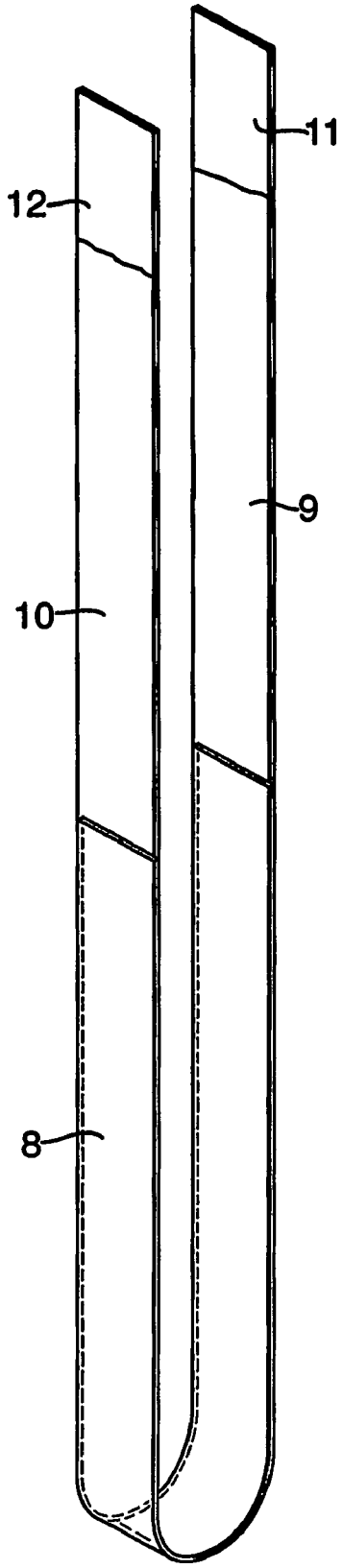
FIG. 4 show a U-shaped one part heating element in accordance with the present invention.

FIG. 4 shows a single piece heating element comprising a simple U-shaped strip having a U-shaped body 8 defining a high resistivity hot zone, and legs defining low resistance cold ends 9,10 and terminal ends 11,12. Modifying silicon carbide to provide regions of differing resistivity in this manner is known technology.

Other shapes of element are envisaged where one or more heating sections may be shaped with more than one bent section in order to conform with the shape of the equipment into which the element(s) will be fitted and/or provide convenient connection to either single phase or 3-phase electric power supply. For example, a W shaped element can readily be made. For a 3-phase heating element three strips may be joined to form a star or other configuration.

Figure 5:
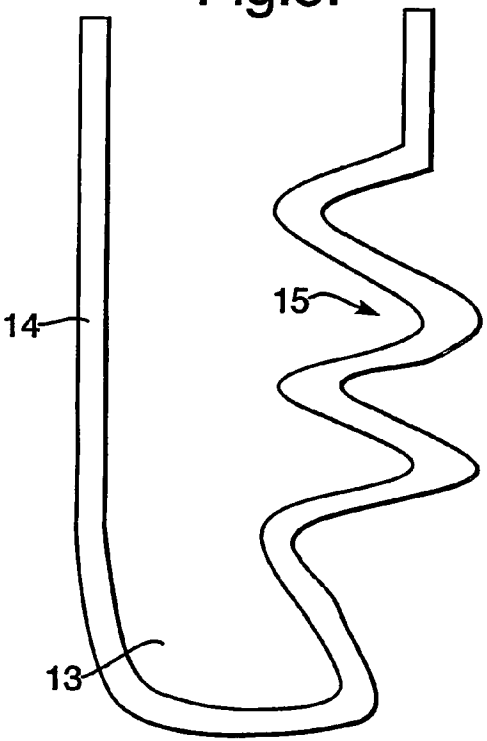
FIG. 5 shows a sinusoidal heating element in accordance with the present invention.

In FIG. 5, a generally U-shaped element 13 comprises a straight leg 14 and a sinusoidal leg 15 giving a greater radiating surface for the length of the element than would be provided by an element with two straight legs.

Figure 6:
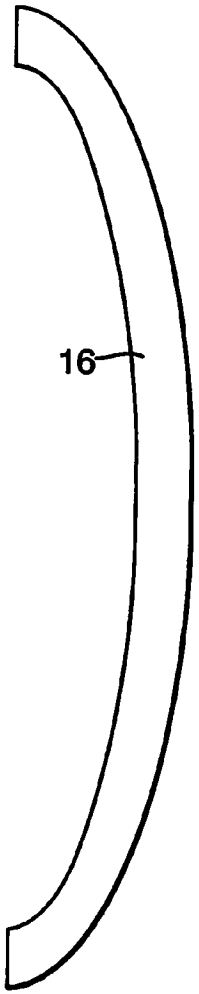
FIG. 6 shows a cross section of a curved strip element in accordance with the present invention.

In FIG. 6, the strip 16 is curved in at least part of its length, rather than flat, so as to provide additional rigidity along its length. Where the strip is bent to form a U it is preferable that the strip is not curved where bent, but only on the straight.

Silicon carbide elements of substantially U-shape are known, and have previously been manufactured using a tubular or solid cylindrical heating section. The bend may be formed either by casting in a mould having the shape of the U, for example by slip-casting, but slip-casting is a non-preferred and relatively expensive method of manufacture for silicon carbide heating elements.

Casting techniques limit the particle size of silicon carbide material that conveniently can be used in manufacture, and where material with coarse grains is required, casting is not seen as a practical manufacturing method. Also, should it be desired to manufacture the heating elements in a high density, reaction-bonded grade of material, then again, slip-casting is a non-preferred route of manufacture, as the casting material or slip must contain both silicon carbide and carbon, and it is not easy to cast such bodies in a controlled or repeatable fashion.

Where volume production of silicon carbide elements is required, the method of manufacture preferred is by extrusion, where silicon carbide grains, or mixtures of silicon carbide and carbon, are blended with binders and plasticisers, so they can be extruded through suitable dies, or die and pin sets, where hollow sections are to be produced. [There may be applications where it could be advantageous for the strip to be hollow (less material required, lighter in weight, easier to bond if 3-piece, lower potential for thermal shock) and the present invention contemplates hollow strips.] Extrusion is a closely controlled and repeatable process, suitable for volume production of high quality electric heating elements in silicon carbide.

As the extruded material must be plastic, in order to extrude, then it is possible to change its shape by bending or forming after extrusion has taken place, but before drying and firing. Consideration has been given to bending or forming conventional rods or tubes from which silicon carbide elements normally may be produced, but there is a major disadvantage inherent in this procedure: Bending the shape extends the length of the exterior circumference of the bend, and reduces the length of the interior circumference. Consequently, material on the outside of the curve is stretched, reducing its density, and material on the inside of the face is compressed, increasing the density or crumpling the material.

With substantially laminar heating sections the thickness of the cross section can be made rather small, thus minimising the difference in circumference between the inner and outer lengths of the curve, and thus minimising changes in the material density, and any distortion or disruption of the extruded material. Advantageously, by bending only out of the plane of the strip (and not bending in the plane of the strip) distortion or disruption of the extruded material can be minimised.

For test purposes the applicant has made silicon carbide heating elements by extrusion having cross sections of 5 mm thickness and 45 mm width (aspect ratio 9:1) and 3 mm thickness and 36 mm width (aspect ratio 12:1).

Once formed, the strip shaped elements can be subject to any of the normal processing steps for silicon carbide heating elements—e.g. impregnation, glazing, metallisation of terminals.

In the present invention a strip-form silicon carbide heating element is provided having a higher radiating surface area to volume ratio than a conventional tubular element.

The invention claimed is:

1. A furnace heating element comprising a heating section comprising an extruded silicon carbide strip having a cross sectional aspect ratio greater than 3:1, wherein heating section comprises a recrystallised self-bonded silicon carbide material.

2. A furnace heating element comprising a heating section comprising an extruded silicon carbide strip having a cross sectional aspect ratio greater than 3:1, wherein the heating element comprises reaction bonded or reaction sintered silicon carbide.

3. A method of making a furnace heating element comprising a heating section comprising an extruded silicon carbide strip having a cross sectional aspect ratio greater than 3:1, the method, comprising:

extruding a heating section strip preform, and bending the extruded preform to shape prior to drying or firing.

4. The method as claimed in claim 3, further comprising separately forming cold ends, and joining the separately formed cold ends to the heating section.

5. The method as claimed in claim 3, further comprising integrally forming cold ends with the heating section.

6. The method as claimed in claim 3, further comprising recrystallizing the heating section, to form a self-bonded silicon carbide material.

7. The method as claimed in claim 3, wherein the material of the extruded preform is such that the final product will comprise reaction bonded or reaction sintered silicon carbide.

8. A furnace heating element comprising a heating section comprising an extruded silicon carbide strip having a cross sectional aspect ratio greater than 3:1, wherein the strip is hollow.

9. The furnace heating element as claimed in claim 1, wherein the strip comprises a planar portion and a portion that is bent out of the plane of the planar portion.

10. The furnace heating element as claimed in claim 1, in which the strip is generally U-shaped.

11. The furnace heating element as claimed in claim 1, wherein at least a portion of the strip has a curved cross-section.

12. The furnace heating element as claimed in claim 1, wherein the cross sectional aspect ratio is greater than 5:1.

13. The furnace heating element as claimed in claim 12, wherein the cross sectional aspect ratio is greater than 10:1.

14. The furnace heating element as claimed in claim 2, wherein the strip comprises a planar portion and a portion that is bent out of the plane of the planar portion.

15. The furnace heating element as claimed in claim 2, in which the strip is generally U-shaped.

16. The furnace heating element as claimed in claim 2, wherein at least a portion of the strip has a curved cross-section.

17. The furnace heating element as claimed in claim 2, wherein the cross sectional aspect ratio is greater than 5:1.

18. The furnace heating element as claimed in claim 17, wherein the cross sectional aspect ratio is greater than 10:1.

* * * * *